United States Patent [19]

Michalik

[11] 4,380,159

[45] Apr. 19, 1983

[54] LEATHER SPLITTING MACHINE

[76] Inventor: John Michalik, 619 Mountain View, La Habra, Calif. 90631

[21] Appl. No.: 255,474

[22] Filed: Apr. 20, 1981

[51] Int. Cl.[3] ..... C14B 1/14

[52] U.S. Cl. ..... 69/12

[58] Field of Search ..... 69/11, 12, 13

[56] References Cited

U.S. PATENT DOCUMENTS 1,704,212 3/1929 Rodman et al. ..... 69/12

3,703,199 11/1972 Townsend ..... 69/13

*Primary Examiner*—Patrick D. Lawson

*Attorney, Agent, or Firm*—Gilbert A. Thomas

[57] ABSTRACT

A leather splitting machine composed of two upright metal plates between which are attached a support roll, a cutting roll each end of which is enclosed in ball bearings which ride in a channel, and a guide roller. A knife edge rests on the cutting roll. All are adjustable to meet the needs of the thickness to be cut. A precalibrated handle along the right side is used to set the machine to the correct thickness by means of a measured guide on the right side of the machine which raises and lowers the cutting roll.

1 Claim, 8 Drawing Figures

LEATHER SPLITTING MACHINE

BACKGROUND OF THE INVENTION

1. Field of the Invention

This machine relates to leather processing machines and in particular a machine that can split leather from 8" to 15" in width and up to ½ thick into sections up to 1/16" thick.

2. Description of the Prior Art

Various patents have been reviewed prior to the filing of this application. In particular U.S. Pat. Nos. 1,990,005, 984,508, 1,375,469 and 4,194,376 were analyzed to examine the possible prior art.

It has formerly been the custom to split leather for belts, shoes, horse finishings and fashion wear by hand or with crude machines in which a fixed knife had leather pushed against it over a roller. Another roller kept the leather from wrinkling or buckling. These crude machines had few adjustments and were not calibrated in order to accomodate the thickness of the leather.

SUMMARY OF THE INVENTION

This invention is composed of an adjustable roller in close proximity to an adjustable knife blade and a precision weight adjusted guide rod which holds the leather against the roller.

A thickness setting for the desired leather is set on the top of the curved frame for variation in the roller distance from the knife edge.

It is an object of this invention to provide a low cost machine that can accurately split leather in thickness down to 1/16 of an inch.

It is a further object of this invention to make a completely adjustable machine for splitting various thicknesses of leather.

It is still a further object of this invention to invent a machine that enables one to split leather goods fast and economical.

DESCRIPTION OF THE PREFERRED EMBODIMENT

Figure 1:
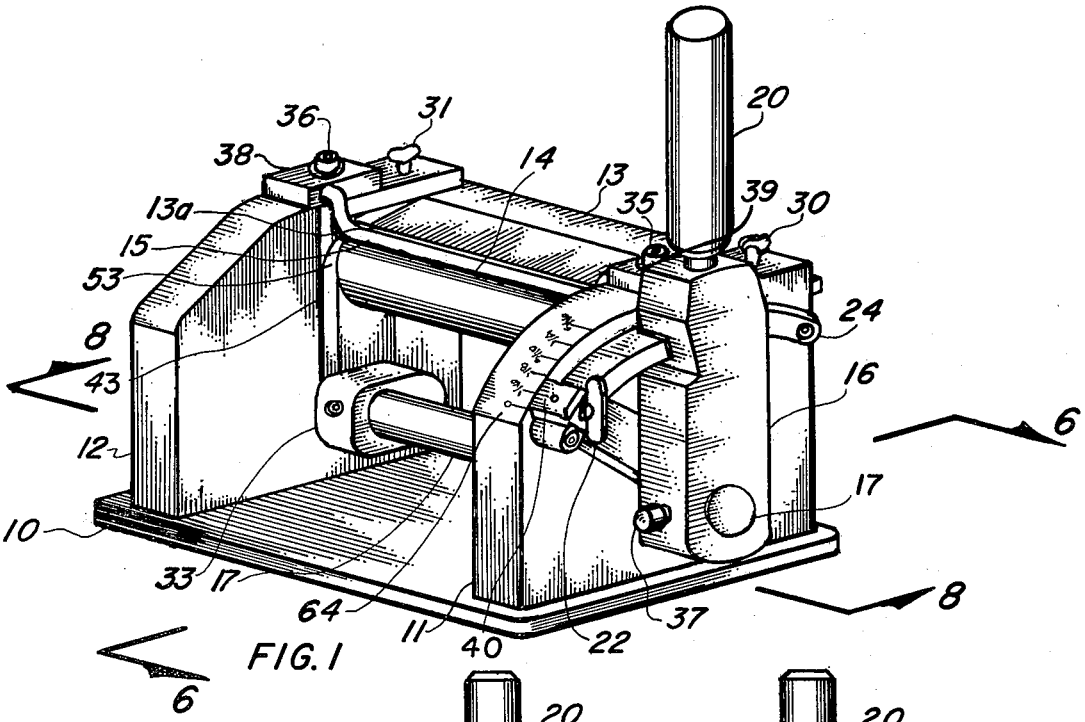
FIG. 1 is a top plan view of the invention.

Referring to the drawings in FIG. 1 we see first a metal base 10 to which are attached two metal plates 11 and 12 at 90° angle. Between them is attached a support rod 17 and a roller 14. A articulated guide rod 15 is suspended at the top of the plates against roller 14.

A knife blade 13 which is set in groves 42 so that the clearance between roller 14 and knife edge 13*a* is the desired finished thickness of the leather.

One end of rod 15 is through one metal block 38 by means of a sleeve bearing in metal block 38. The other goes through metal block 39 and terminates so as not to interfer with guide handle 16.

The metal blocks 38 and 39 are attached to metal plates 11 and 12 by means of socket bolts 35 and 36.

Figure 6:
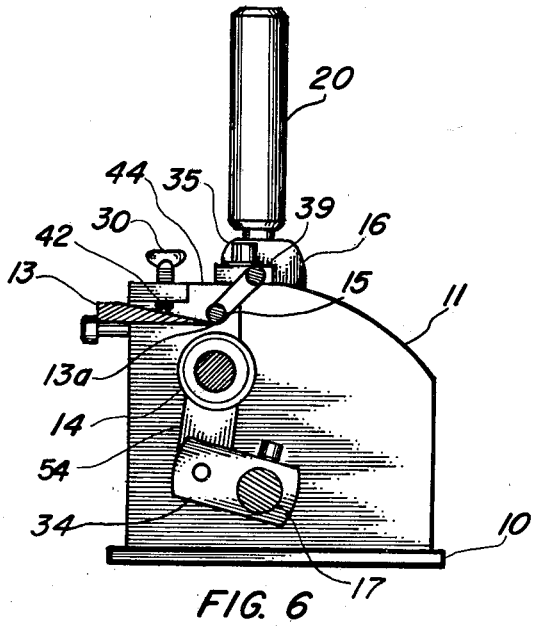
FIG. 6 is a left side section view through 6—6 of FIG. 1.
Figure 7:
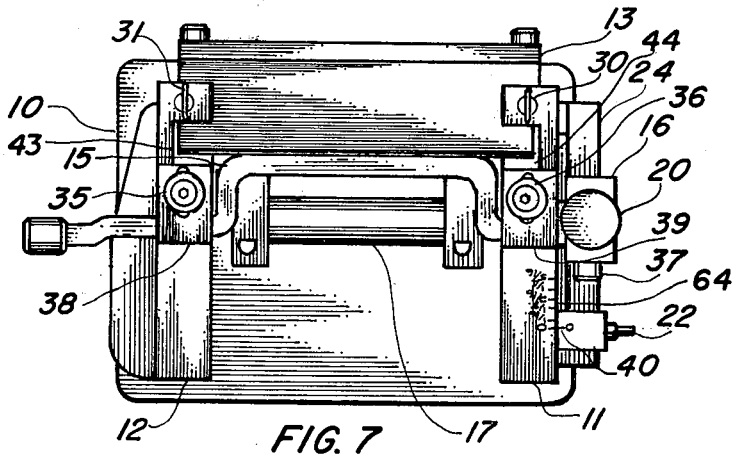
FIG. 7 is a top view through 7—7 of FIG. 2.

Turning now to FIG. 6. The roller 14 travels in grooves 43 and 44 which are identically made on plates 11 and 12, by means of ball bearings 43 and 44 not shown. One end of roller 14 being in each bearing.

Figure 2:
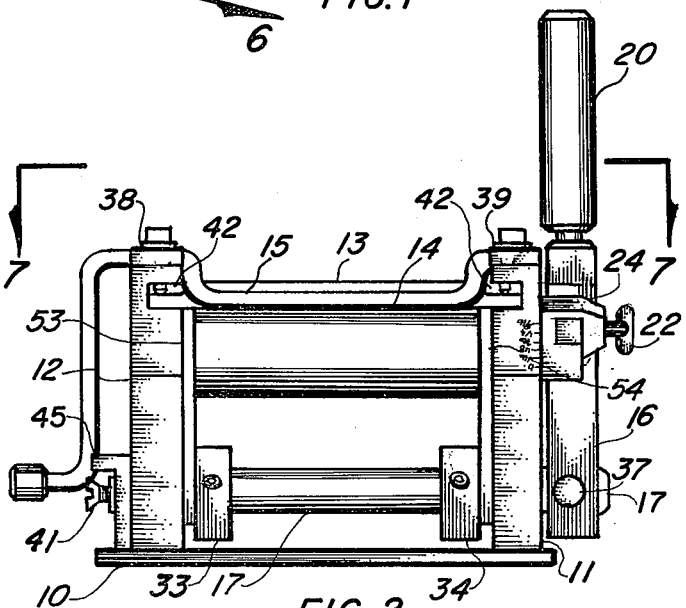
FIG. 2 is a rear view of the invention.
Figure 3:
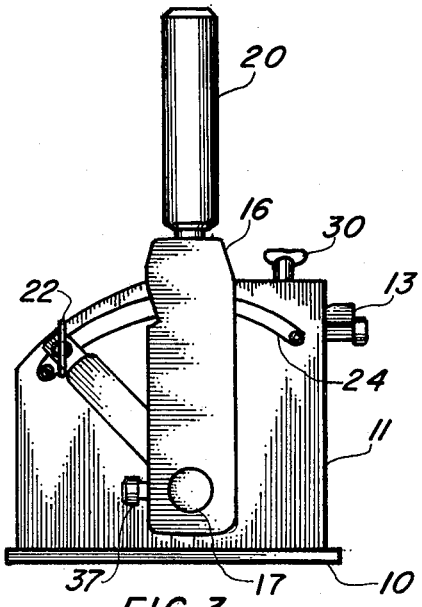
FIG. 3 is a left side view of the invention.
Figure 4:
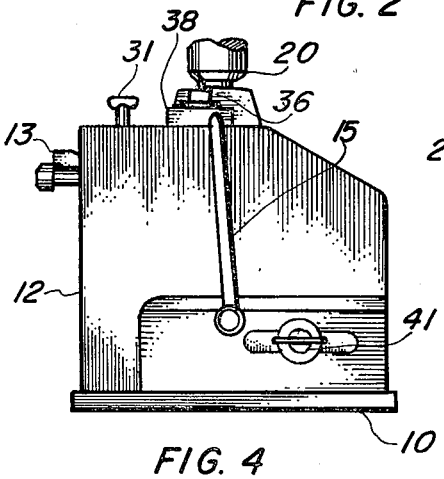
FIG. 4 is a right side view of the invention.
Figure 5:
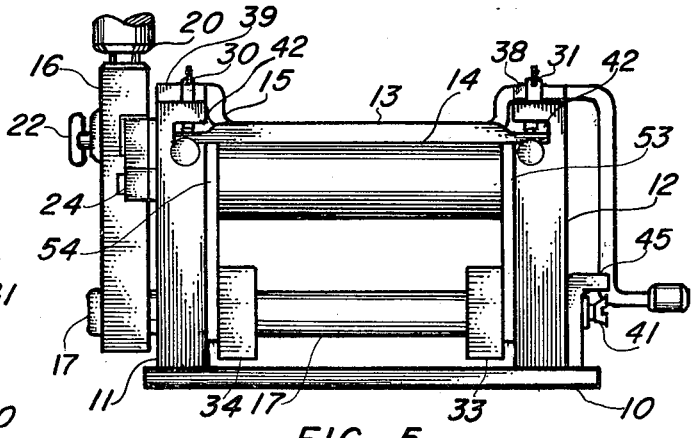
FIG. 5 is a front view of the invention.

In FIGS. 2 and 3. Attached to support rod 17 are two cams that are pinned to two flat connecting rods 53 and 54. The flat connecting rods 53 and 54 are attached to the shaft of roller 14 causing it to move up and down in the grooves 43 and 44 when handle 16 is rotated. Grip 20 is screwed into handle 16 to form a one piece arm and at the same time the screw is used to lock an arc 24 at desired leather thicknesses.

Guide rod 15 has a bent extension going down to register 45. This register can be adjusted to desired precision by winged bolt 41 to keep the guide rod 15 pressed against the leather being split.

Figure 8:
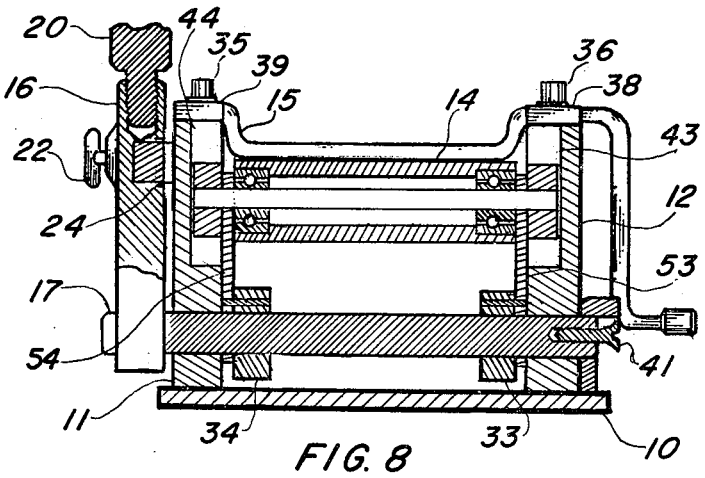
FIG. 8 is a front section view through 8—8 of FIG. 1.

The handle arm 16 can be adjusted along gauge 64 which has 1/16 inch graduations along the face thereof. This has the effect of moving cams 33 and 34 which are pinned to flat connecting rods 53 and 54 moving roller 17 through channels 43 and 44 shown on FIG. 8 and adjusting the distance from knife edge 13*a* to that desired for leather splitting. When the desired thickness of the leather is reached wing bolt 22 is tightened on stop setting 40 against arc 24 holding roller 14 in the correct setting against knife edge 13.

Wing bolts 30 and 31 control the adjustment of knife 13 in channel 42 allowing for a full adjustment of distances.

Arm 16 is rigidly attached to support roller 17 by bolt 37.

It can be seen that many other versions of the basic machine can be produced and still not vary the basic ideas herein incorporated.

I claim:

1. An adjustable leather splitting machine that incorporates in combination:

a base attached to to metal plates at a 90° angle to the base to which is attached:

a support roller, and a guide roller with ball bearings on either end, running in channels for preselected adjustment of the thickness of leather to be split;

a knife adjustable for wear and lubrication;

a adjustable guide rod to assist in holding the leather against the roller;

at one side of the metal plates is an adjustment arm that controls the opening between the roller and knife edge according to premarked numbers on an articulate guide for the thickness of leather desired;

a scale along the side of the machine next to the arm;

two cams on the support roller which are rotated by the arm and engage two flat connecting rods that raise and lower the roller as directed by the arm;

the two cams are adjustable by set screws on top of each cam for perfect parallelism between roller and knife;

the arm is resettable by set screws to zero on the scale after wear of long use or repair;

the guide rod is adjustable for the distance between the knife edge on to of the two plates and the pressure against the roller by the plate on the opposite side of the arm; and the thickness selector stop uses the same arms and cams as the roller and a support rod to center the axis to avoid wabbling.

* * * * *